United States Patent [19]

Horton et al.

[11] Patent Number: 4,527,643

[45] Date of Patent: Jul. 9, 1985

[54] ROTARY CUTTING MEMBER FOR DRILLING HOLES

[75] Inventors: M. Duane Horton; L. Brent Horton, both of Provo, Utah

[73] Assignee: Megadiamond Industries Inc., Provo, Utah

[21] Appl. No.: 464,401

[22] Filed: Feb. 7, 1983

[51] Int. Cl.[3] ..... E21B 10/46

[52] U.S. Cl. ..... 175/329; 175/410

[58] Field of Search ..... 175/329, 330, 409, 410; 51/309, 307, 308; 125/39

[56] References Cited

U.S. PATENT DOCUMENTS

| | | | |
|---|---|---|---|
| 2,562,587 | 7/1951 | Swearingen | 125/39 |
| 2,565,333 | 8/1951 | Weidman et al. | 175/410 X |
| 2,598,459 | 5/1952 | Steffes | 175/410 |
| 3,745,623 | 7/1973 | Wentorf, Jr. et al. | 29/95 |
| 3,894,673 | 7/1975 | Lowder et al. | 125/39 X |
| 4,109,737 | 8/1978 | Bovenkerk | 175/329 |
| 4,252,102 | 2/1981 | Phaal et al. | 125/39 |
| 4,333,540 | 6/1982 | Daniels et al. | 175/329 |

*Primary Examiner*—Stephen J. Novosad
*Assistant Examiner*—Michael Starinsky
*Attorney, Agent, or Firm*—Willian, Brinks, Olds, Hofer, Gilson & Lione Ltd.

[57] ABSTRACT

A cutting element for drilling holes is disclosed which consists of five cutting edges which are comprised of polycrystalline diamond or the like mounted to a central carbide substrate or similar hard material held by a rotatable shaft which can be inserted into a drilling machine. The polycrystalline material is unsupported with respect to torsional forces exerted upon it during drilling. An advantage of this cutting member is its ability to cut straight new holes in hard or abrasive materials for substantially longer periods of time than presently available rotary drills.

15 Claims, 4 Drawing Figures

ROTARY CUTTING MEMBER FOR DRILLING HOLES

BACKGROUND OF THE INVENTION

1. Field of the Invention

This invention relates to a cutting element having at least five cutting edges. The cutting edges are comprised of polycrystalline diamond or the like attached to cemented carbide or a similar hard material which is held by a rotating shaft. The cutting element is so shaped and positioned that it may be used to drill holes.

Throughout the following disclosure, the phrase "polycrystalline material" or "polycrystalline diamond" is intended to cover all super abrasion-resistant polycrystalline materials comprised of randomly oriented crystals which are directly bonded to adjacent crystals, including but not limited to polycrystalline diamond, polycrystalline cubic boron nitride, polycrystalline wurtzite boron nitride, and combinations thereof.

2. Prior Art

Drills used in machining operations usually operate with a simultaneous cutting and wedging action. One common form of these drills is the flat drill. This drill is comprised of a substantially flat portion or blade member and a rotatable shaft. The rotatable shaft has a central axis and its top end may have several configurations. In its simplest form, the top is planar and perpendicular to the central axis of the rotatable shaft while in a version having better support for the flat portion, the top has four surfaces sloping up from the perimeter of the shaft towards the central axis. Also located at the top of the shaft is a slit which forms a diameter line on the top of the shaft running through the central axis of the shaft and from one point on the perimeter of the shaft to another point on the perimeter of the shaft. This slit is positioned so that the four sloping surfaces are divided into two pairs of surfaces.

The slit through the top of the rotatable shaft is adapted to receive the substantially flat portion and hold it in a fixed position for the drilling operation. The substantially flat portion has two opposing pentagonal faces. At the top of the substantially flat portion is a chisel edge which is perpendicular to the central axis of the rotatable shaft. The midpoint of the chisel edge intersects the central axis of the shaft. A vertical plane passing through the chisel edge intersects the vertical planes passing through the lines where the pairs of sloped surfaces meet, usually at a non-perpendicular angle. The top end of the flat portion also has two other cutting edges known as the lips of the drill which extend from each end of the chisel edge and slope downward and away from the central portion of the rotatable shaft.

Each lip provides the leading edge to a cutting lip surface which slopes down from the lip and across the top of the substantially flat portion. The pairs of sloping surfaces of the rotatable shaft are positioned below the top of the substantially flat edge portion, thus exposing part of the pentagonal faces of the substantially flat portion. The cutting lip surfaces terminate at the chisel edge.

The flat portion has two additional cutting edges, called the margins which form the leading edges of margin surfaces at the sides of the substantially flat portion. Each margin is parallel to the central axis of the rotatable shaft and extends downward from the lip along an edge of the pentagonal face. The length of the margin can be varied. A plane containing a margin and the central axis is non-perpendicular to a plane passing through the margin surface. The margin and lip meet at the peripheral corner of the flat portion. These margin surfaces are parallel to each other.

Thus the flat portion has five cutting edges, the chisel edge, two margins and two lips. Each pentagonal face of the flat portion has a margin and a lip and the central end points of the lips provide opposite end points of the chisel cutting edge.

As the drill rotates about its axis, it is forced against a workpiece. As the drill contacts and begins to penetrate the workpiece, the chisel edge is subjected to compressive forces. This results in a wedging or chiseling action whereby the workpiece material displaced by the drilling action moves toward the outer ends of the lips. As this occurs, the lips begin to cut into the workpiece and remove chips or fragments of the workpiece. This cutting action subjects the lips to torsional forces. When a drill is new or recently resharpened, the margins perform no or little cutting action. The peripheral corners, however, remove more material than the inner portions of the lips. As a result, after continued use of the flat drill, the peripheral corners become somewhat rounded. After the peripheral corners where the margin meets the lip begin to wear, the margins increase their function as a cutting edge and the ability of the lips to cut is reduced.

As the lips continue to wear, the compressive forces of the drill must be increased to maintain the ability of the drill to penetrate the workpiece. With workpieces where the drill passes through and out the back side of the workpiece, the dulling of the drill causes burrs or frays at the exit hole of the workpiece as well as requiring increased drilling forces. In blind drilling, where the drill does not pass through the entire workpiece, the dulling of the drill requires additional drilling forces. When the additional drilling forces required reach a predetermined level or where exit holes on workpieces become frayed, it becomes necessary to terminate drilling operations and replace or resharpen the flat drill. The flat drill is usually resharpened by machining the cutting lip planes of the substantially flat portion until the rounded peripheral corners are eliminated. When the cutting lip planes have been machined down to the point where the margins are too short, the drill is no longer an effective cutting element and is disposed. The need to frequently remove the flat drills to replace or resharpen them increases down time in manufacturing operations. Furthermore, drilling with dulled cutting surfaces increases the risk of ruining a workpiece, thereby increasing the amount of scrap created in the manufacturing operation. Both the frequent resharpening and the high percentage of scrap due to dull cutting edges increases the cost of the manufacturing or drilling operations.

Drill bits have traditionally been made from steel. Alternatively cemented tungsten carbide has been used when the drilling material is harder or more abrasive than that which steel is capable of drilling. In cases such as the machining of silicon-aluminum alloys and other materials, even drills with cemented tungsten carbide experience rapid wear at their cutting edges and require frequent replacement.

Recently, the machining of both harder materials as well as more abrasive materials has increased which has introduced a great need for drills which can withstand machining such materials. The use of cutting tools made from wear resistant materials such as polycrystalline diamond or polycrystalline cubic coron nitride to machine harder or abrasive surfaces has been disclosed. (See U.S. Pat. No. 3,745,623 for Diamond Tools for Machining issued to Robert H. Wentorf, Jr. on Dec. 27, 1971). In addition, boring bars tipped with polycrystalline diamond can be used as effective devices for machining the interior surfaces of pre-existing holes. However, none of these tools are designed for or are suitable for drilling new holes in abrasive materials.

In addition to the above tools tipped with polycrystalline diamond, non-planar diamond surfaces with an underlying carbide substrate which provides a backing for the diamond layer have been disclosed. (See U.S. Pat. No. 4,109,737 for Rotary Drill Bit issued to Harold Bovenkerk on Aug. 29, 1978 and U.S. Pat. No. 4,333,540 for Cutter Element and Cutter for Rock Drilling issued to William Daniels and John Cheatham on June 8, 1982). These diamond surfaces are in the shape of a dome or wedge and are used for elements in rock drills where they encounter forces that are substantially normal or perpendicular to the diamond-carbide interface. In each of these prior art devices the polycrystalline diamond surface is supported by the carbide structure against forces applied against the polycrystalline diamond. This diamond-carbide interface is not subjected to torsional forces and consequently is not designed to withstand such forces created during drilling. As a result, these prior art devices use polycrystalline diamond surfaces which are supported in the direction of the forces to which they are subjected and do not employ polycrystalline diamond surfaces which are unsupported in the direction of torsional forces.

3. Objects of the Invention

It is therefore the general object of the present invention to alleviate the aforementioned problems. It is another general object to provide a rotary member employing polycrystalline material on the cutting edges for drilling new holes in abrasive materials where the polycrystalline material is unsupported in the direction of torsional drilling forces. It is yet another general object of this invention to provide a rotary member for drilling holes with cutting edges of polycrystalline material that will wear less rapidly than drills presently available. It is yet another general object of the present invention to provide a blade member or rotary member for drilling holes wherein the polycrystalline material forming cutting edges can withstand the torsional forces encountered during drilling so that they will not chip or break off.

It is a specific object of the present invention to provide a rotary member employing abrasion resistant material for drilling holes in abrasive materials wherein the cutting edges are comprised of polycrystalline diamond mounted upon a cemented carbide surface in planes non-parallel to the axis of the drill such that the diamond is unsupported against torsional drilling forces. It is another specific object of the present invention to provide a rotary member for drilling holes wherein polycrystalline material is deposited on two sloped planes at the top of a carbide substrate such that the leading edges of the resulting cutting lip planes are parallel to the diamond-carbide interface and the polycrystalline material is unsupported against torsional drilling forces.

SUMMARY OF THE INVENTION

The present invention is a cutting element having five cutting edges for drilling holes. The cutting edges are comprised of polycrystalline diamond or the like mounted to a cemented carbide substrate or a similar hard material which is held by a rotatable shaft with a central axis. The polycrystalline material is mounted to a cemented carbide substrate and it is unsupported with respect to torsional forces exerted upon it during drilling. The shaft is adapted for insertion into a drilling machine.

In the preferred embodiment of the invention, the cutting element is in the form of a substantially flat portion for a flat drill. The rotatable shaft has four shaft surfaces sloping up from the perimeter of the shaft towards the central axis. A slit through the top of the rotatable shaft divides the sloping shaft surfaces into two pairs of shaft surfaces. This slit holds the substantially flat portion which comprises a cemented carbide substrate having polycrystalline material attached to its top. The carbide substrate has two opposing substantially parallel pentagonal faces. Located at the top of the substrate is an edge which may be rounded and is perpendicular to the central axis of the shaft. This edge is also the intersection of two sloping surfaces located on top of the substrate. Polycrystalline material or polycrystalline diamond is mounted to both of these substrate surfaces. The leading edge of each polycrystalline diamond coated surface is called a cutting lip edge which lies in a plane which is parallel to the substrate. The cutting lip surfaces meet to form the chisel edge which is located at the uppermost part of the substantially flat portion. The thickness of the diamond at the outermost end of the lip forms a cutting edge called the margin.

The substantially flat portion is attached to the rotatable shaft, which is in turn inserted into a drill. When the drill is rotated about its central axis and the cutting edges are forced against a workpiece, the polycrystalline material is unsupported with respect to the torsional forces of drilling.

In another embodiment of the invention, in addition to having the polycrystalline diamond in the cutting lip surfaces, it is also deposited along both sides of the carbide substrate. This results in margins which extend over the length of the substantially flat portion. The carbide substrate is attached to the shank which is inserted into a drilling machine such that both the lips and margins are unsupported against the torsional forces of drilling.

DESCRIPTION OF THE DRAWINGS

The present invention will be more clearly understood from the following detailed description of specific embodiments read in conjunction with the accompanying drawings, wherein.

It should be understood that the drawings are not necessarily to scale and that the embodiments are illustrated by graphic symbols, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION

Figure 1B:
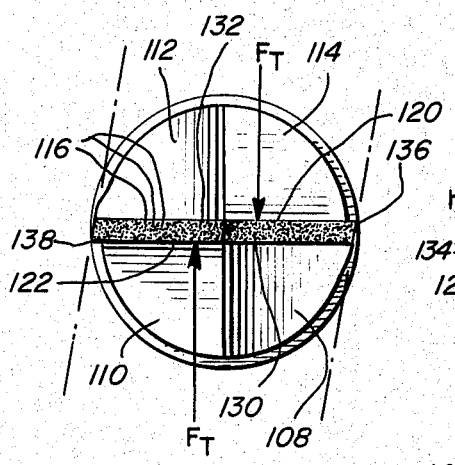
FIG. 1B is a top view of the flat drill shown in FIG. 1A.
Figure 2:
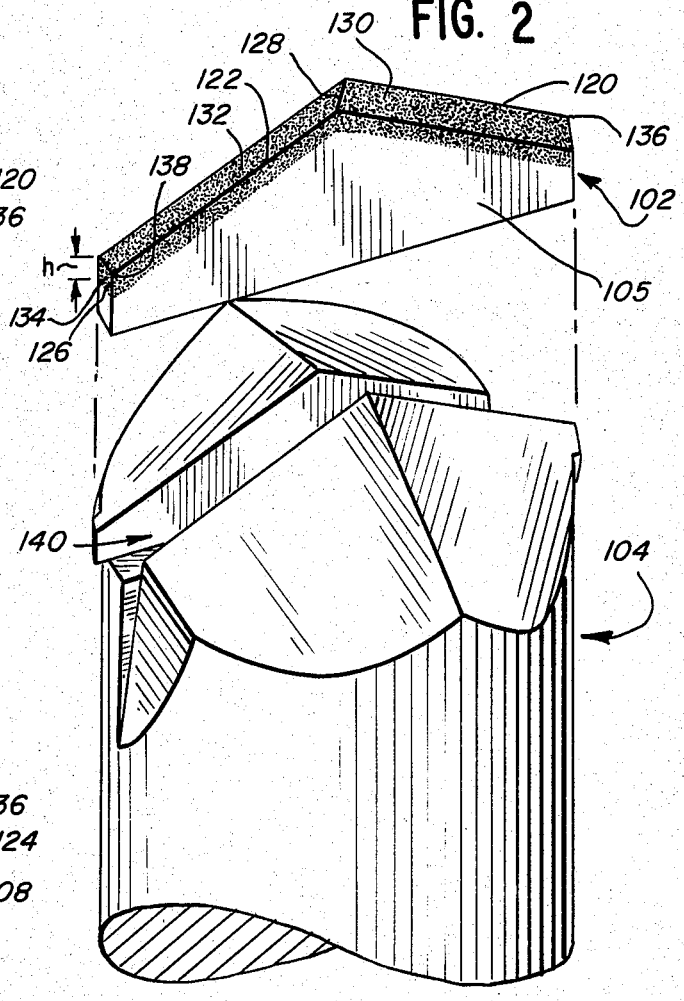
FIG. 2 is an exploded perspective drawing of a rotary cutting member for drilling holes made in accordance with this invention having a rotatable shaft and a substantially flat portion with five cutting edges where polycrystalline diamond is mounted to a carbide substrate.
Figure 1A:
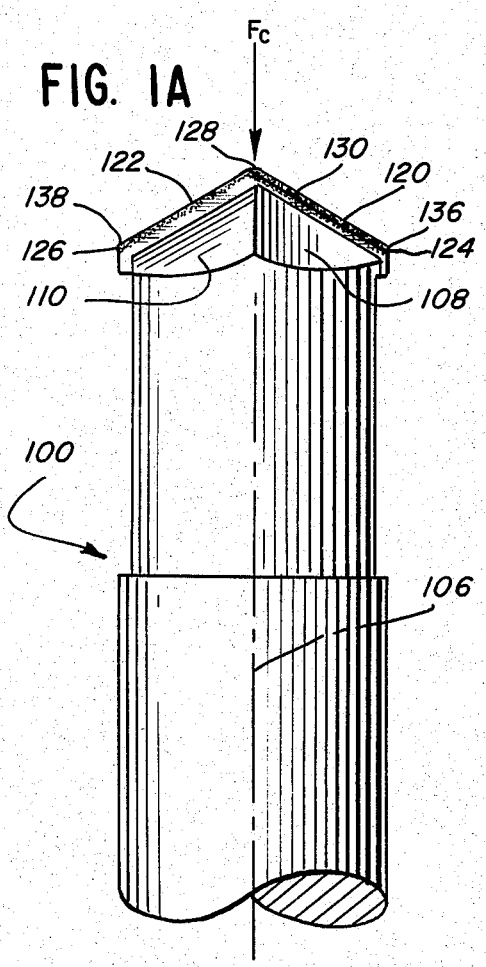
FIG. 1A is an elevational view of a flat drill made in accordance with this invention where the drill shaft has been cut away to show that the length of the shaft can vary.

FIGS. 1A, 1B and 2 show a flat drill 100 comprising the substantially flat portion or blade member 102 and a rotatable shaft 104 having a central axis 106 made in accordance with the present invention. The following description will be with general reference to FIGS. 1A, 1B and 2 unless otherwise specified. The substantially flat portion 102 has its pentagonally shaped face 105 substantially parallel to its opposing face. FIG. 1B shows the top view of the flat drill 100. FIG. 1B shows the rotatable shaft 104 with a central axis 106 and four surfaces 108, 110, 112, 114 sloping up from the perimeter of the shaft 104 towards the central axis 106. The top of the shaft 104 has a slit 140 (shown in FIG. 2) and the bottom portion of the shaft 104 is machined to be held by a drilling machine (not shown). The substantially flat portion 102 is mounted in the slit by brazing or other suitable methods. The location of the slit divides the four sloping surfaces 108, 110, 112, 114 into two pairs of sloping surfaces. One pair of sloping surfaces 108, 110 is shown in FIG. 1A. The sloping surfaces 108, 110 are machined so that a portion of the pentagonal face 105 of the substantially flat portion 102 is exposed. In this embodiment, a vertical plane passing through the lines where each pair of sloping surfaces intersect includes the central axis 106.

The substantially flat portion 102 is comprised of polycrystalline material 116 mounted onto the top of the base portion or substrate surface portion of the flat portion 102. In the preferred embodiment, the flat portion 102 is placed in the slit 140 after which the polycrystalline material 116 is machined to form and sharpen the cutting edges. It should be understood that in alternative embodiments, machining the polycrystalline diamond can be done before placing the flat portion 102 in the slit 140. Mounting the polycrystalline material 116 onto the substrate surface of the flat portion 102 results in a flat drill 100 having five cutting edges: two cutting lips 120, 122; two margins 124, 126; and a chisel edge 128 as shown in FIG. 1B. The cutting lips 120, 122 each provide a leading edge to corresponding cutting lip surfaces 130, 132 which are sloped downward. The cutting lip surface 130 in FIG. 1A with leading edge or lip 120 is positioned above the sloped surface 108 of the shaft 104 so that when in use, the top of the shaft does not rub against the material being drilled. FIG. 1A also shows that a portion of the pentagonal face 105 is exposed and intersects with the shaft at the shaft's sloped surfaces 108, 110. This exposed area provides a space for the fragments or chips of the material being cut by the lips 120, 122 of the drill. The cutting lip surfaces 130, 132 terminate or meet at the chisel edge 128 which is perpendicular to the central axis 106 of the shaft 104 and intersects the central axis 106. The margin 126 provides a leading edge to a surface 134 which is directed inward toward the central axis 106. In the preferred embodiment, the margin surfaces are substantially parallel to each other and to a vertical plane passing through the chisel edge 128. In alternative embodiments, the margin surfaces need not be parallel to each other or the chisel edge. The margins 124, 126 and lips 120, 122 meet at peripheral corners 136, 138. The length of the margins 124, 126 is determined by the thickness of polycrystalline material 116 mounted to the substrate surface. The remaining length of the sides of the flat portion can be varied.

In the preferred embodiment, the polycrystalline diamond 116 can be mounted by directly depositing it onto the top surface or substrate of the flat portion 102. In an alternative method (not shown), the polycrystalline diamond may be joined to the substrate by other means.

FIG. 1B is a top view of the flat drill 100 shown in FIG. 1A and has been marked with the same numbers to further illustrate the preferred embodiment. It should be appreciated that the cutting lips 120, 122 are each the leading edge of corresponding cutting lip surfaces 130, 132. It should also be understood that the sloped surfaces 108, 110, 112, 114 are below the polycrystalline/-substrate interface.

As the drill 100 is rotated about its central axis 106 in the X direction, the cutting lips 120, 122 are subjected to torsional forces $F_T$. While the top surface or substrate of the flat portion 102 supports the polycrystalline diamond 116 from compressive forces $F_c$ as viewed in FIG. 1A, it does not provide any support or backing for the torsional forces $F_T$ as shown in FIG. 1B. The realization that the polycrystalline diamond material can be used to form a cutting edge which is not supported by additional material from torsional forces makes the structure of the present invention possible.

FIG. 2 shows an exploded perspective view of the flat drill 100 shown in FIGS. 1A and 1B wherein the polycrystalline material is shaped according to the preferred embodiment of this invention. The slit 140 of the rotatable shaft 104 is shown. The interface of the polycrystalline diamond layer 116 and top surface or substrate of the flat portion 102 is parallel to the cutting lips 120, 122. Thus the thickness h of the polycrystalline diamond layer 116 remains constant over both cutting lips 120, 122 except near the chisel edge 128 where the rounding of the substrate point may create a thicker polycrystalline material layer. In the embodiment shown here, the point angle A is 118°, which is the preferred lead angle for steel. As is well known, other drilling materials have different preferred lead angles and the present invention is not limited to any angle but rather can be made with different angles for use with different materials. The only polycrystalline diamond 116 which appears on the sides is near the peripheral corners 136, 138 where the cutting lips 120, 122 meet the margins 124, 126. This limits the height of the margins 124, 126 to the thickness h of the polycrystalline diamond layer 116.

The substantially flat portion 102 is attached to the slit 140 of the rotatable shaft 104 which has a bottom portion which can be inserted into a drilling machine (not shown). The flat drill 100 thus has a polycrystalline diamond layer 116 with cutting lips 120, 122 which are unsupported with respect to torsional forces and supported only with respect to compressive forces.

The hard abrasive resistant surface that is provided by the diamond layer 116 allows for new holes to be drilled in hard or abrasive machining materials without support against the torsional forces of drilling. The presence of the hard polycrystalline material 116 on the top surface or substrate of the flat portion 102 substantially increases the time that the flat drill 100 can be used without requiring resharpening. This reduction in necessary resharpening enables the drilling machine to operate for substantially longer periods of time without work stoppages due to the wearing of the drill. In addition, where the drilling operation requires an exit hole in the workpiece, substantially more workpieces can be machined without burrs on the exit hole, thus reducing the number of rejects or finished products out of specification.

Figure 3:
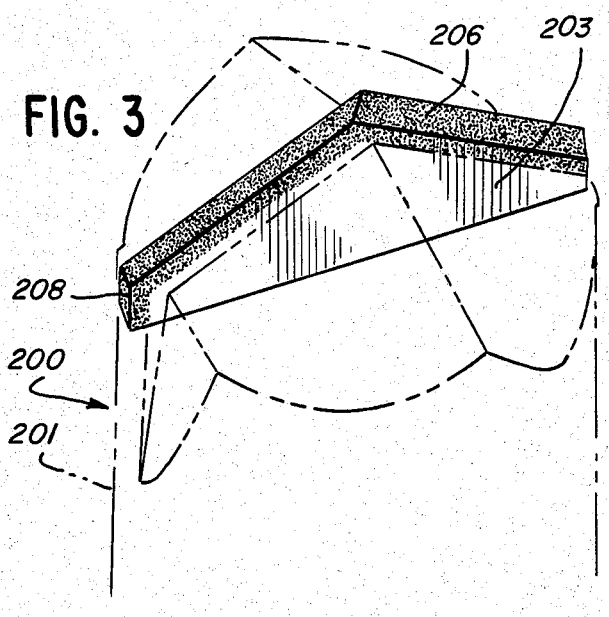
FIG. 3 is a perspective drawing of the flat portion of a rotary member for drilling holes made in accordance with this invention where the margin extends over the length of the substantially flat portion.

FIG. 3 shows a perspective view of a flat drill 200 which is an alternative embodiment of this invention. Phantom lines show the rotatable shaft 201 holding the flat portion 203. The following description refers to the left hand side of the flat portion 201 unless otherwise specified. The right hand side of the flat portion, rotated 180°, is the exact shape as the left hand side. Mounted to the left side of the flat portion 203 is a polycrystalline layer 206 resulting in a left margin 208, along the entire length of the flat portion 203. By extending the diamond layer 206 over the length of the sides to form the margin, the life of the flat drill 200 may be extended slightly.

It should be understood by a person skilled in the art that other embodiments of this invention exist. It may not be necessary that the point angle be of any particular degree or that the diamond layer be of any particular thickness. Nor is it necessary that a diamond layer cover the entire length of the sides of the carbide subtrate. The essential thing is that the diamond is supported only at the diamond/carbide interface and that there is no additional carbide surface to support the diamond against torsional forces encountered during drillings.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A rotary flat drill bit comprising:

a shaft having a central axis; and a blade member comprising a base portion connected to one end of said shaft and a polycrystalline material portion comprised of randomly oriented crystals which are directly bonded to adjacent crystals, said polycrystalline material portion forming a plurality of cutting edges and extending across said central axis such that said axis divides said polycrystalline material portion into a first part and a second part and during drilling each of said parts is subjected to torsional forces from opposing directions, said polycrystalline material portion bonded to said base portion forming a polycrystalline material base interface, said interface being substantially parallel to said torsional forces.

2. A rotary flat drill bit as set forth in claim 1 wherein said base portion has two sloping top surfaces which meet along a line which is perpendicular to the central axis of said shaft; said polycrystalline material being bonded to said two sloping top surfaces of said base portion forming a first cutting lip surface and a second cutting lip surface.

3. A rotary flat drill bit as set forth in claim 2 wherein said first cutting lip surface has a first leading edge and said second cutting lip surface has a second leading edge and wherein said first cutting lip surface and said second cutting lip surface meet to form a chisel edge.

4. A rotary flat drill bit as set forth in claim 3 wherein said base portion has two side surfaces, said polycrystalline material deposited upon said top surface of said body portion forming an extension of said side surfaces equal to the thickness of said polycrystalline material, the first one of said side surface extensions being slanted at a first angle relative to a vertical plane passing through said chisel edge, the second one of said side surface extensions being slanted at a second angle relative to said vertical plane, the magnitude of said first angle and said second angle being substantially equal, said polycrystalline material portion of said first side surface extension forming a first margin surface and said polycrystalline material portion of said second side surface extension forming a second margin surface.

5. A rotary flat drill bit as set forth in claim 4 wherein said first margin surface has a first leading edge and said second margin surface has a second leading edge.

6. A rotary flat drill bit as in claim 2 wherein each of said top surfaces is substantially planar.

7. A rotary flat drill bit as set forth in claim 3 wherein said base portion has two side surfaces, said polycrystalline material deposited upon each of said top surfaces of said body portion forming an extension of said side surfaces equal to the thickness of said polycrystalline material, the first one of said side surface extensions being parallel to a vertical plane passing through said chisel edge, the second one of said side surface extensions being parallel to said vertical plane, said polycrystalline material portion of said first side surface extension forming a first margin surface and said polycrystalline diamond portion of said second side surface extension forming a second margin surface.

8. A rotary flat drill bit as set forth in claim 7 wherein said first margin surface has a first leading edge and said second margin surface has a second leading edge.

9. A rotary flat drill bit as in claim 3 wherein said first cutting lip surface is slanted at a positive angle relative to a horizontal plane passing through said line, and said second cutting lip surface is slanted at a negative angle relative to said plane and the magnitude at said positive angle is substantially equal to the magnitude of said negative angle.

10. A rotary flat drill bit as set forth in claim 1 wherein said base portion has two sloping top surfaces which meet along a line which is perpendicular to the central axis of said shaft; said base portion also having two side surfaces, said polycrystalline material bonded to said side surfaces of said base portion forming a first margin surface and a second margin surface, said first margin surface being parallel to said second margin surface.

11. A rotary flat drill bit as set forth in claim 10 wherein said first margin surface has a first leading edge and said second margin surface has a second leading edge.

12. A rotary flat drill bit as set forth in claim 11 wherein said polycrystalline material is also bonded to said sloping surfaces of said base portion forming a first cutting lip surface slanted at a positive angle relative to a horizontal plane passing through said line, and a second cutting lip surface slanted at a negative angle relative to said plane and the magnitude of said positive angle is substantially equal to the magnitude of said negative angle; and said first cutting lip surface has a first leading edge and said second cutting lip surface has a second leading edge and said first cutting lip surface and said second cutting lip surface meet to form a chisel edge.

13. A rotary flat drill bit as in claim 10 wherein each of said top surfaces is substantially planar.

14. A rotary flat drill bit comprising:

a shaft having a central axis, a first end adapted for insertion into a driving tool, and a second end with a slot running perpendicular to said axis for receiving a blade member; and a blade member fitted and bonded in said slot comprising a base portion with two sloping top surfaces, and a polycrystalline material portion comprised of randomly oriented crystals which are directly bonded to adjacent crystals, said polycrystalline material portion extending the length of and bonded to said top surfaces forming a polycrystalline material/base interface; said polycrystalline material portion thereby extending across said central axis and comprising a first cutting lip surface with a first leading edge and a second cutting lip surface with a second leading edge, said cutting lip surfaces meeting to form a chisel edge, each of said top surfaces being planar and substantially parallel to torsional forces exerted on said blade member during drilling, said interface being substantially parallel to said torsional forces.

15. A rotary flat drill bit as in claim 14 wherein the polycrystalline material portion further comprises a front surface and a back surface, each of said surfaces extending across said central axis and generally oriented transverse to torsional forces exerted on said blade member during drilling, and each of said surfaces being exposed.

* * * * *

UNITED STATES PATENT AND TRADEMARK OFFICE

CERTIFICATE OF CORRECTION

PATENT NO. : 4,527,643

DATED : July 9, 1985

INVENTOR(S) : M. Duane Horton and L. Brent Horton

It is certified that error appears in the above-identified patent and that said Letters Patent is hereby corrected as shown below:

IN THE DETAILED DESCRIPTION

In column 5, line 46, please delete "surface";

In column 6, line 64, please delete "to" and substitute therefor --in--;

Signed and Sealed this

Twenty-first Day of October, 1986

[SEAL]

*Attest:*

DONALD J. QUIGG

*Attesting Officer*

*Commissioner of Patents and Trademarks*